US008661694B2

(12) United States Patent
Bijsterveldt et al.

(10) Patent No.: US 8,661,694 B2
(45) Date of Patent: Mar. 4, 2014

(54) PORTABLE HAND-HELD POWER TOOL

(75) Inventors: Hugo van Bijsterveldt, Didam (NL); Rikard Rydberg, Norrahammar (SE); Peter Bjorkman, Nassjo (SE)

(73) Assignee: Husqvarna AB, Huskvarna (SE)

( * ) Notice: Subject to any disclaimer, the term of this patent is extended or adjusted under 35 U.S.C. 154(b) by 287 days.

(21) Appl. No.: 13/142,744

(22) PCT Filed: Dec. 30, 2008

(86) PCT No.: PCT/SE2008/051571

§ 371 (c)(1), (2), (4) Date: Aug. 11, 2011

(87) PCT Pub. No.: WO2010/077195

PCT Pub. Date: Jul. 8, 2010

(65) Prior Publication Data

US 2011/0289786 A1 Dec. 1, 2011

(51) Int. Cl.
*B27B 17/00* (2006.01)
*B25H 3/00* (2006.01)

(52) U.S. Cl.
USPC ..... 30/381; 30/298.4; 30/383

(58) Field of Classification Search
USPC ..... 30/296.1, 298.4, 381, 383; D8/65
See application file for complete search history.

(56) References Cited

U.S. PATENT DOCUMENTS

| | | | | |
|---|---|---|---|---|
| 2,708,525 A | | 5/1955 | Woleslagle | |
| 2,810,409 A | * | 10/1957 | Ibelle et al. | 30/122 |
| 2,839,831 A | * | 6/1958 | Baer | 30/298.4 |

(Continued)

FOREIGN PATENT DOCUMENTS

| | | | |
|---|---|---|---|
| EP | 1033207 A2 | | 9/2000 |
| JP | 2003094401 A | | 4/2003 |
| JP | 2010-208329 | * | 9/2010 |
| WO | WO 2010/115438 A1 | * | 10/2010 |

OTHER PUBLICATIONS

International Search Report and Written Opinion, issued on Aug. 17, 2009, for PCT/SE2008/051571, International Search Authority.

(Continued)

*Primary Examiner* — Hwei C Payer
(74) *Attorney, Agent, or Firm* — Nelson Mullins Riley & Scarborough LLP

(57) ABSTRACT

A portable handheld power tool (1), such as a chain saw or a power drill, having a receiving device (100) arranged on a body portion (2) of the power tool (1). The receiving device (100) is arranged for connecting/disconnecting to the portable handheld power tool (1) either a flexible elongated member, such as a rope, or a fastening device secured to the elongated member or to an operator of the portable handheld power tool (1). The receiving device (100) has a receiving portion (110) for receiving and leading the flexible elongated member therethrough. The receiving portion (100) extends substantially in a plane (P). Furthermore, the receiving device (100) has an attachment portion (120) which is arranged to connect the receiving device (100) to a body portion (2) of the portable handheld power tool (1) by means of a pivot assembly (4). The pivot assembly (4) defines a pivot axis (PA), permitting the receiving portion (110) to move between a resting position, wherein the plane of the receiving portion (110) is essentially parallel to the pivot axis (PA), and an operating position. In the operating position, the receiving portion (110) is movable about the pivot axis (PA), and the plane (P) of the receiving portion is essentially perpendicular to the pivot axis (PA).

17 Claims, 4 Drawing Sheets

(56) References Cited

U.S. PATENT DOCUMENTS

| | | | | | |
|---|---|---|---|---|---|
| 3,317,098 | A * | 5/1967 | Auraen | 224/609 |
| 3,346,955 | A * | 10/1967 | Beneke | 30/276 |
| 4,787,145 | A * | 11/1988 | Klicker et al. | 30/275.4 |
| 5,272,813 | A | 12/1993 | Wolf et al. | |
| 5,570,512 | A * | 11/1996 | Hoppner | 30/383 |
| 5,822,867 | A * | 10/1998 | Sakai | 30/298.4 |
| 5,930,903 | A * | 8/1999 | Hurn et al. | 30/391 |
| 5,992,025 | A | 11/1999 | Fricke | |
| 6,732,627 | B2 * | 5/2004 | Wattenbach et al. | 83/701 |
| 7,942,299 | B2 * | 5/2011 | Steinbrunner et al. | 227/156 |
| D660,120 | S * | 5/2012 | Tajik et al. | D8/65 |
| 2002/0046468 | A1 | 4/2002 | Kobayashi | |
| 2004/0226174 | A1 * | 11/2004 | Etter et al. | 30/298.4 |
| 2012/0031635 | A1 * | 2/2012 | Svennung et al. | 173/20 |

OTHER PUBLICATIONS

International Preliminary Report on Patentability, issued on Mar. 22, 2011, for PCT/SE2008/051571, International Search Authority.

* cited by examiner

P
z
x
y
115
121
122
120
110 y
x
124
123
121
122 y
z
110
120
121a
121b
121
122

15
15a
15b
15c
15d
15e

PORTABLE HAND-HELD POWER TOOL

TECHNICAL FIELD

The invention relates to a portable hand-held power tool such as a motor-driven chain saw, which portable hand-held power tool has a receiving device.

BACKGROUND

In general, motor-driven chain saws have a body portion with a motor mounted therein and a saw bar positioned at the front end of the body portion. Motor-driven chain saws having a handle mounted on the top of the body portion are generally referred to as top-handle chain saws. Their design is especially suited for advanced tree care, to be carried out by professional operators. Such advanced tree care includes pruning and delimbing standing trees, and the operator often uses the top-handle chain saw while he or she is climbing a tree.

In order to facilitate the work performed by the chain saw operator, chain saws for use in this kind of situations are equipped with a receiving device for connecting e.g. a rope or a hook to the body portion of the chain saw. One end of the rope may be connected to a harness worn by the operator. The rope may also be used for sending the chain saw up to an operator who has already climbed a tree that is to be pruned or treated in some other way. Such usage of the chain saw is demanding and implies that the receiving device as well as the rope satisfy certain requirements regarding wear resistance, weight and user-friendliness.

U.S. Pat. No. 5,272,813 discloses a top-handle chain saw having a receiving device which defines an eyelet through which an operator can pass a rope. When the rope runs through an eyelet as the one described in U.S. Pat. No. 5,272,813 the rope will be exposed to hard wear, which might have a negative effect on the surface of the rope after a certain period of use.

Accordingly, there is a need for a portable handheld power tool, having an improved receiving device, which receiving device minimizes the wear and tear of an object that is attached to it, and which receiving device is low-weight and is easy-to-use.

SUMMARY

It is an object of the present invention to provide a portable handheld power tool, which has a low-weight, easy-to-use receiving device, which receiving device can be easily manufactured at a low cost and requires a minimum of space when it is not used, and which receiving device furthermore minimizes the wear and tear of an object that is attached to it.

It is also an object of the present invention to provide a top-handle chain saw having a receiving device that provides a possibility to attach several external objects simultaneously to a body portion of the chain saw.

According to a first aspect of the solution, at least one of these objects is achieved by a portable handheld power tool according to claim 1. The power tool has a receiving device arranged on a body portion of the power tool. The receiving device is arranged for connecting/disconnecting to the portable handheld power tool either a flexible elongated member, such as a rope, or a fastening device secured to the elongated member or to an operator of the portable handheld power tool. The receiving device has a receiving portion for receiving and leading the flexible elongated member therethrough. The receiving portion extends substantially in a plane. Furthermore, the receiving device has an attachment portion which is arranged to connect the receiving device to a body portion of the portable handheld power tool by means of a pivot assembly. The pivot assembly defines a pivot axis, permitting the receiving portion to move between a resting position, wherein the plane of the receiving portion is essentially parallel to the pivot axis, and an operating position. In the operating position, the receiving portion is movable about the pivot axis, and the plane of the receiving portion is essentially perpendicular to the pivot axis.

By providing a receiving device having a receiving portion which is movable about the pivot axis when it is in the operating position, and which is essentially perpendicular to the pivot axis when it is in the operating position, a receiving portion having an optimal extension direction when used is achieved, and at the same time, the receiving device is flexible, and can adapt to the direction of an external object that is connected to it. These to features provides a receiving device that is easy to use and minimizes the wear and tear of an object that is connected to the receiving device.

According to an embodiment of the invention, the receiving portion of the receiving device is recessed in a recess of the non-moving part of the portable handheld power tool, when the receiving portion is in its resting position. In this way the receiving portion is completely hidden when it is not used, and does not constitute an obstruction for the operator.

According to another embodiment of the invention, the receiving portion and the attachment portion are formed integrally from one single piece of material. In this way, a simple receiving device is provided, which requires a minimum of parts, and which is consequently easy to manufacture in a cost-efficient way.

According to another embodiment of the invention, the receiving portion and the attachment portion are made of spring wire, which results in a slightly flexible receiving device that has low weight and is easy to manufacture.

According to yet another embodiment of the invention, the attachment portion comprises a first sub portion for connecting the receiving device to the pivot assembly in the resting position, and a second sub portion for connecting the receiving device to the pivot assembly in the operating position. The second sub portion extends in a plane that is essentially perpendicular to another plane in which the first sub portion extends.

By providing an attachment portion like that, the receiving device will rotate around two mutually perpendicular axes as it is brought from the resting position to the operating position. In this way the receiving device can be brought between an optimal resting position and an optimal operating position.

According to another embodiment of the invention, the second sub portion of the attachment portion extends in essentially the same plane as the receiving portion. In that way, an optimal extension direction for the receiving portion is achieved, when it is in its operating position.

According to another embodiment of the invention, the pivot assembly has a fastening pin. The first sub portion and the second sub portion are separated by an intermediate sub portion, defining a passage that is narrower than a diameter of the fastening pin, in order to retain the receiving device in either the operating position or the resting position, wherein the intermediate sub portion is resilient, so as to permit a snap-in movement of the receiving device relative to the pivot assembly between the operating position and the resting position of the receiving device.

By providing such a narrow intermediate sub portion, the receiving device is secured in either the operating position or the resting position, and will not move between the two positions unintentionally. By making the intermediate sub portion resilient, a user can easily bring the receiving device between the two positions by means of a snap-in movement.

According to yet another embodiment of the invention, the receiving device comprises a hook receiving component, arranged for connecting an external object, such as a snap hook, to the body portion of the portable handheld power tool by means of the pivot assembly. In that way, several external objects can be attached to the portable handheld power tool at the same time.

According to another embodiment of the invention, the hook receiving component is arranged to have only a limited mobility in relation to the pivot axis defined by the pivot assembly. By providing a hook receiving component that is substantially fixed in relation to the pivot assembly, fastening of a hook—hanging from a harness of a user of the power tool—to the hook receiving component is facilitated.

According to a second aspect of the invention, top-handle chain saw according to the first aspect of the invention is provided. The receiving device is arranged on a body portion of the top-handle chain saw.

According to a third aspect of the invention, a top-handle chain saw is provided, which top-handle chain saw has a receiving device for connecting external objects, such as elongated flexible members, e.g. a rope, and spring hooks, to a body portion of the chain saw. The receiving device has a flexible member connecting component having a receiving portion for receiving and leading the flexible elongated member or a part of a fastening device secured to the elongated member therethrough, and an attachment portion for connecting the rope lope component to the body portion by means of a pivot assembly defining a pivot axis. The receiving device also has a hook receiving component for connecting an external object, such as a snap hook, to the body portion.

In that way, a top handle chain saw to which a safety rope as well as a hook can be attached at the same time.

According to an embodiment of the third aspect of the invention, the hook receiving component is arranged to be connected to the body portion of the chain saw by means of the same pivot assembly as the flexible member connecting component.

By providing such a solution, a minimum of parts is needed for manufacturing of the receiving device, and a low weight is achieved.

According to another embodiment of the third aspect of the invention, the hook receiving component is arranged to be detachably connected to the chain saw body portion. In this way, the operator of the chain saw can remove the hook receiving component when it is not needed.

According to yet another embodiment of the third aspect of the invention, a main extension plane of the receiving portion of the flexible member receiving component and a main extension plane of the hook receiving component are arranged to be connected to the pivot assembly such that the main extension plane of the hook receiving component is essentially perpendicular to the main extension plane of the flexible member receiving component. In this way the two components are suitable for different purposes and complement each other.

According to another embodiment of the third aspect of the invention, the flexible member connecting component is arranged to be pivotable about the pivot axis, so as to permit the receiving portion to move between a resting position, and an operating position. In this way, a the receiving portion can be hidden when it is not used.

According to another embodiment of the third aspect of the invention, the receiving portion is movable about the pivot axis, and a main extension plane of the receiving portion is essentially perpendicular to the pivot axis, when the flexible member connecting component is in its operating position. When the flexible member connecting component is in its resting position, the main extension plane of the receiving portion is essentially parallel to the pivot axis. In that way, the receiving portion will rotate around two mutually perpendicular axes as it is brought from the resting position to the operating position. In this way the flexible member receiving component can be brought between an optimal resting position and an optimal operating position.

According to yet another embodiment of the third aspect of the invention, the body portion is arranged to hold the receiving device and the pivot assembly such that the pivot axis of the pivot assembly is essentially parallel to a horizontal plane of the body portion of the top handle chain saw.

In this way, optimal extension directions for the receiving portion and the hook receiving component are achieved.

According to another embodiment of the third aspect of the invention, the hook receiving component has a curved portion for receiving an external object, which curved portion has the shape of a distorted U, comprising a first leg section, a second leg section, and a base section interconnecting the two leg sections. The second leg section extends at an angle with the first leg section. By providing a second leg section that extends at an angle with the first leg section, removal of an external object from the hook receiving component is facilitated.

BRIEF DESCRIPTION OF THE DRAWINGS

The invention will be understood and appreciated more fully from the following detailed description, taken in conjunction with the drawings, in which.

DESCRIPTION

Figure 1:
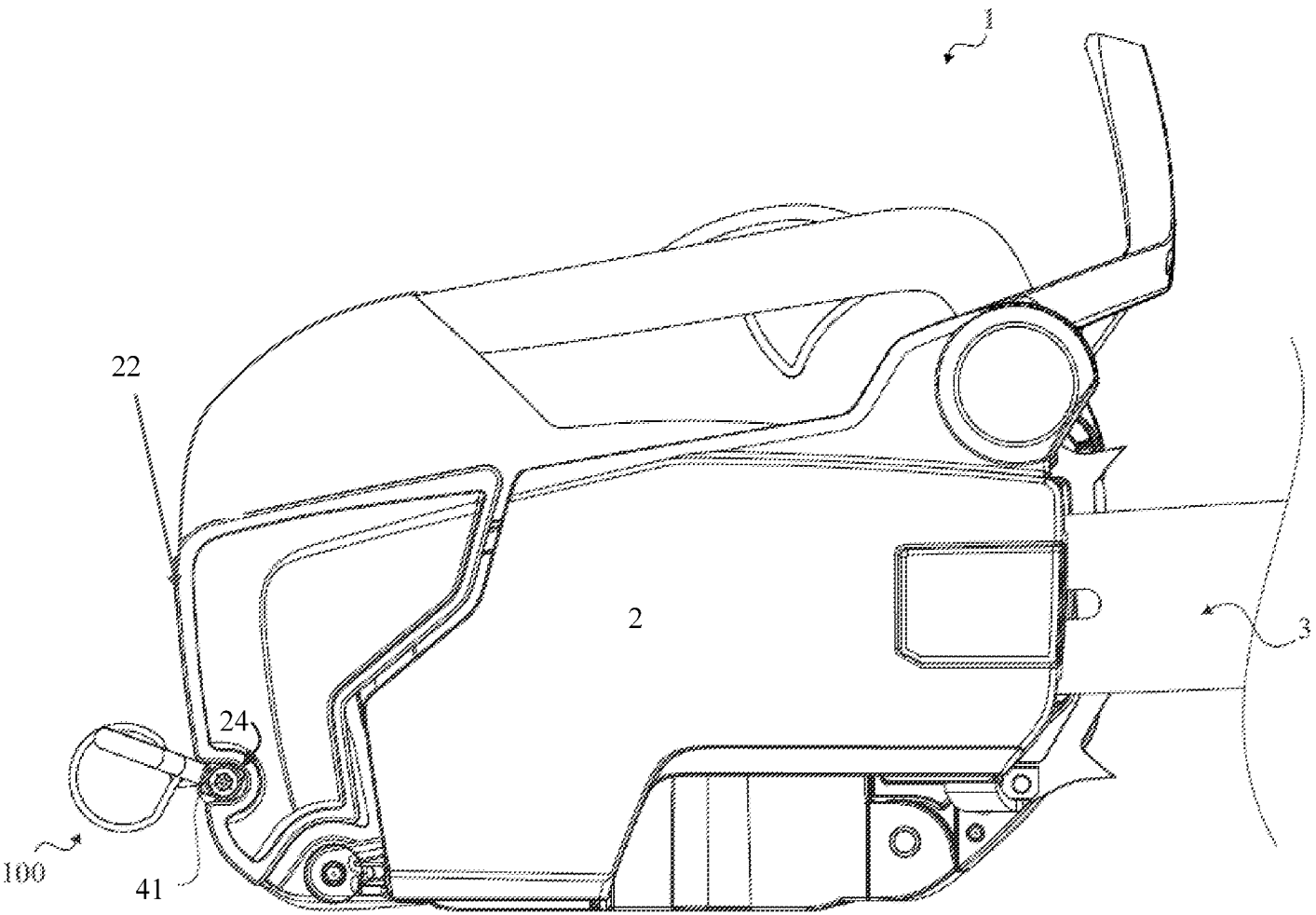
FIG. 1 is a side view of a part of a top-handle chain saw according to the invention.

The present invention will be described more fully hereinafter with reference to the accompanying drawings, in which preferred embodiments of the invention are shown. The invention may, however, be embodied in many different forms and should not be construed as limited to the embodiments set forth herein; rather these embodiments are provided so that this disclosure will be thorough and complete, and will fully convey the scope of the invention to those skilled in the art. In the drawings, like numbers refer to like elements.

FIG. 1 shows a part of a motor-driven chain saw 1 having a body portion 2 in which a combustion engine (not shown) is mounted. The body portion 2 has a front end, a rearward end 22, a top, a bottom, and opposing sides extending between the front end and the rearward end 22. A chain guide bar 3 extends from the front end of the body portion 2 in the longitudinal direction of the chain saw. A saw chain (not shown), driven by the engine, runs along a groove formed on the periphery of the chain guide bar 3.

The chain saw shown in FIG. 1 is generally known as a top-handle chain saw because of its configuration with a handle mounted on the top of the body portion. The design of top-handle chain saws makes them especially suited for advanced tree care, performed by arborists. In general, a top-handle chain saw also has a handle on a side of the body portion.

The rearward end 22 of the body portion 2 is arranged to hold a receiving device 100, which may be used for connecting an elongated flexible member, such as a rope, to the body portion 2. The rope is generally attached to a harness, which is worn by the chain saw operator. The receiving device 100 can also be used for connecting the chain saw more directly to a harness, e.g. by connecting a snap hook, which is attached to the harness, to the receiving device 100.

Figure 2B:
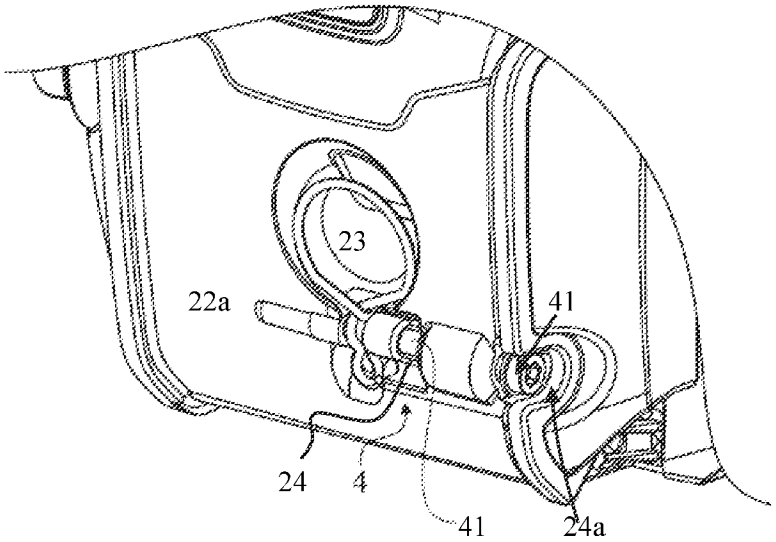
FIG. 2*b* shows the receiving device of FIG. 2*a*, in its resting position.
Figure 2A:
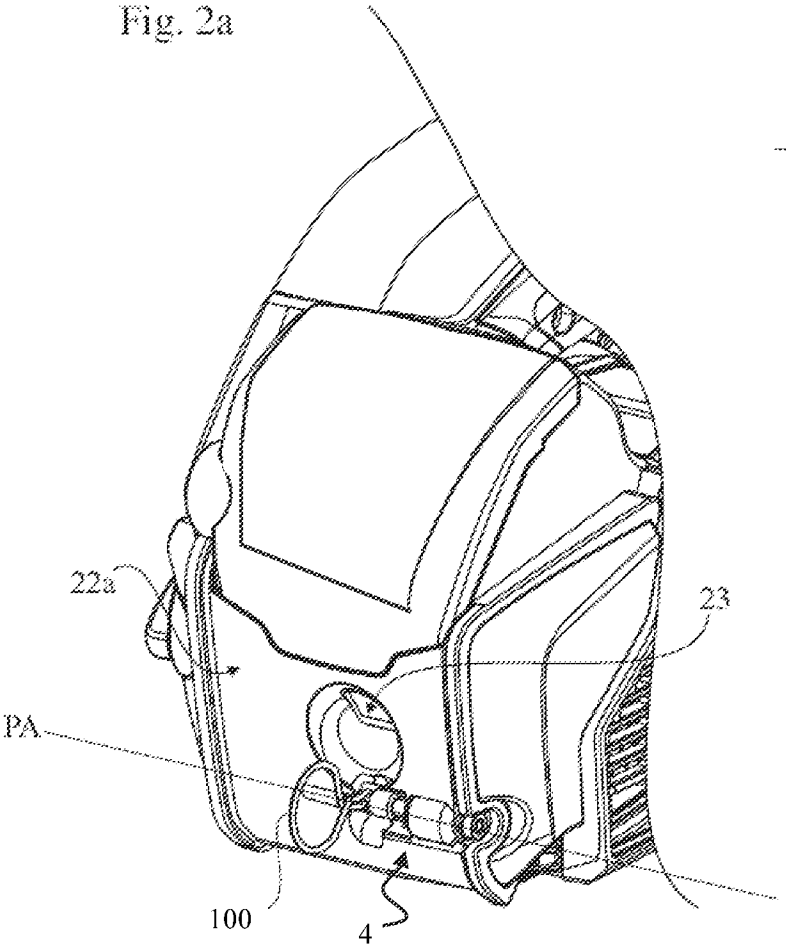
FIG. 2*a* is a detail view of a rearward end of the body portion of the top-handle chain saw of FIG. 1, showing one embodiment of the receiving device, in its operating position.

A portion of a rearward end 22 of a chain saw body portion 2 is shown in FIG. 2*a*. A receiving device 100 according to one embodiment of the invention is mounted on the rearward end 22. As shown in FIG. 2*a*, a recess 23 is formed in a surface 22*a* of the rearward end 22. The shape of the recess 23 is preferably complementary to the shape of the receiving device 100, so as to permit the receiving device 100 to be recessed in the recess 23 when the chain saw operator does not want to use the receiving device 100.

A receiving device 100 according to the present invention has one or several components. According to a first embodiment of the invention, the receiving device 100 is a flexible member connecting component 115, which is hereinafter referred to as a rope loop 115. An embodiment of a rope loop 115 is shown in FIGS. 3*b*-3*d*.

The rope loop 115 is preferably constructed from a single piece 15 of material, such as a piece 15 of spring wire, and is formed by bending the piece 15 of material into a receiving portion 110, and an attachment portion 120.

Figures 3A, 3B, 3C, 3D:
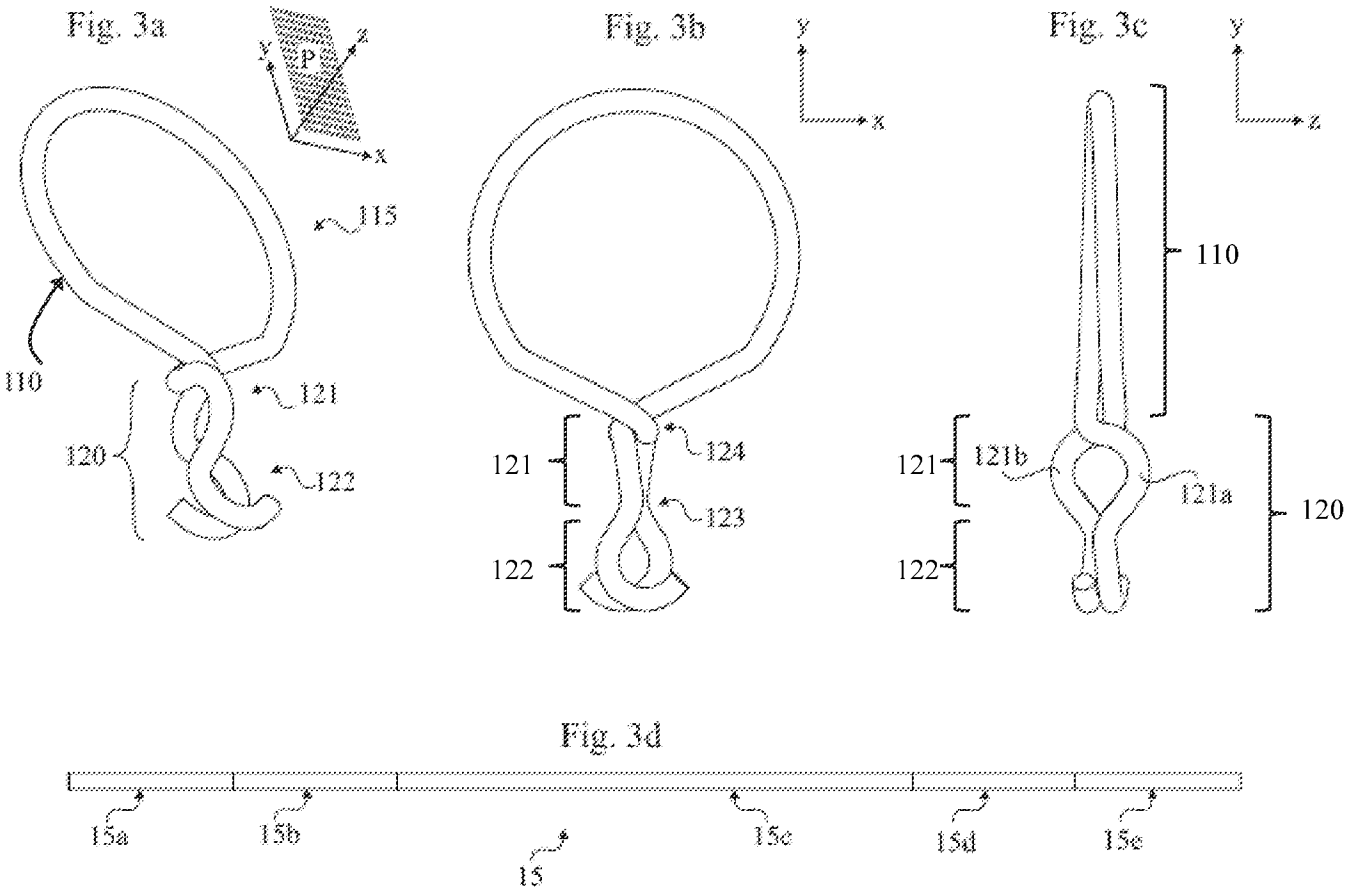
FIG. 3*a* is a perspective view of a receiving device according to an embodiment of the invention
FIG. 3*b* is a top plan view of the receiving device of FIG. 3*a*.
FIG. 3*c* is a side view of the receiving device of FIGS. 3*a* and 3*b*.
FIG. 3*d* shows a piece of material before being formed into a receiving device according to an embodiment of the invention.

FIGS. 3*a*-3*c*, which include X-Y-Z axes imposed on the figures, are different views of the rope loop 115.

The receiving portion 110 is arranged to receive an elongated flexible member, such as a rope, whereas the purpose of the attachment portion 120 is to connect the rope loop 115 to the chain saw body portion 2. The attachment portion 120 has a rest position eyelet 121 and an operation position eyelet 122, as described hereinafter.

An unbent piece 15 of spring wire, which is suitable to be bent into the shape of a rope loop 115 according to the invention, is shown in FIG. 3*d*. The piece 15 of spring wire has a first outer leg segment 15*a*, a first inner leg segment 15*b*, a mid segment 15*c*, a second inner leg segment 15*d* and a second outer leg segment 15*e*.

To form the receiving portion 110 of the rope loop 115, the mid segment 15*c*, of the piece 15 of spring wire is bent into an essentially circular loop. According to an embodiment of the receiving portion 110, the diameter of this loop is about 20-30 mm. The outer ends of the mid segment 15*c* cross each other in a first connection point 124, such that the receiving portion 110 forms one convolution of a helical shape. The receiving portion 110 lies essentially in an X-Y plane P, as shown in FIGS. 3*a*-3*c*.

Adjacent to the first connection point, the outer ends of the mid segment 15*c* of the piece 15 of spring wire continue into the inner leg segments 15*b*, 15*d*. The inner and outer leg segments 15*a*, 15 *b*, 15*d*, 15*e* are bent to form the attachment portion 120 of the rope loop 115.

As best shown in FIG. 3*c*, a first sub portion 121 of the attachment portion 120 is formed by bending the inner leg segments 15*b*, 15*d* of the piece 15 of spring wire into two opposed C-shaped sections 121*a*, 121*b*, such that an eyelet extending in an Y-Z plane is formed. The outer ends of the inner leg segments 15*b*, 15*d* approach each other in a transition region 123, which defines a boundary between the first sub portion 121 of the attachment portion 120 and a second sub portion 122 of the attachment portion 120.

The second sub portion 122 of the attachment portion 120 is formed by bending the outer leg segments 15*a*, 15*e* of the piece 15 of spring wire into an eyelet that extends in essentially the same plane P as the receiving portion 110. The outer leg segments 15*a*, 15*e* are bent such that they have a radius of curvature which is essentially equal to the radius of curvature of the C-shaped sections 121*a*, 121*b*.

In order to secure an appropriate tensile strength of the second sub portion 122, the outer ends of the outer leg segments 15*a*, 15*e* of the piece 15 of spring wire are arranged to overlap when forming the second sub portion 122, as shown in FIG. 3*b*.

A pivot assembly 4, comprising a fastening pin 41, is used for connecting the receiving device 100 to the chain saw body portion 2. In the embodiment shown in the attached drawings, the pin 41 is inserted in an essentially horizontal groove 24 defined in the rearward end 22 of the chain saw body portion 2. The groove 24 is positioned in front of the rearward end surface 22*a* and adjacent to it, such that the extension direction of the groove 24 is essentially parallel to a plane in which the actual portion of the rearward end surface 22*a* extends. As shown in FIG. 2*b*, the groove 24 has an entry 24*a* for inserting the fastening pin 41. The groove 24 is at least partially covered by the rearward end surface 22*a*, so as to define a tubular channel in which the fastening pin 41 is to be captured. One or several openings revealing the inside of the groove 24, are formed in the rearward end surface 22*a* in positions where the receiving device 100 is to be connected to the pin 41.

In the embodiment shown in the attached drawings, the fastening pin 41 is a self-tapping hex cap screw 41 or a self-tapping hex cap bolt 41. The screw or bolt 41 has a non-tapered shaft having a threaded portion in the end that is proximal to the cap. The rest of the shaft is preferably unthreaded. The threads cut into the walls of the groove 24 as the screw is driven into the groove. The operator may for example use a hex key for driving the screw 41 into the groove 24.

The position of the groove is preferably chosen such that the chain saw bar will extend in a direction that is convenient for the operator, when the chain saw hangs in the receiving device.

The pivot assembly defines a pivot axis PA, and the rope loop 115 is arranged to be pivotable about this pivot axis PA.

When the rope loop 115 is in its resting position, the first sub portion 121 of the attachment portion 120 clasps the pin 41 of the pivot assembly 4. Consequently, the first sub portion 121 is hereinafter referred to as a resting position attachment eyelet 121.

When the rope loop 115 is in its operating position, the second sub portion 122 of the attachment portion 120 clasps the pin 41 of the pivot assembly 4. Consequently, the second sub portion 122 is hereinafter referred to as an operating position attachment eyelet 122. The radii of curvature of the two attachment eyelets 121, 122 are chosen such that the shape of each attachment eyelet 121, 122 is essentially complementary to the diameter of the attachment pin 41.

The transition region 123 defines a passage that is narrower than the diameter of the fastening pin 41.

When the chain saw operator does not want to use the rope loop 115, he or she will place the rope loop 115 in its resting position, wherein the rope loop is recessed in the recess 23. The resting position attachment eyelet 121 clasps the fastening pin 41 and the extension plane P of the receiving portion 110 is essentially parallel to an extension plane of the surface 22*a* of the rearward end side 22, in a part of the surface in which the recess 23 is formed. The Y-axis of the rope loop extends in the vertical direction of the chain saw body portion 2, and the X-axis of the rope loop 115 extends in the same direction as the pivot axis PA of the pivot assembly 4. A rope loop 115 in the resting position is shown in FIG. 2*b*.

In order to bring the rope loop to the operating position, the operator grips the receiving portion 110 and pivots it around the pivot axis PA defined by the attachment pin 41 while turning the rope loop 115 around its Y axis. Preferably, the shape of the recess 23 in the chain saw body portion 2 is adapted for guiding the movement of the rope loop while it is brought from the resting position to the operating position. As the receiving portion 110 moves in a rearward direction relative to the chain saw body portion, i.e. away from the body portion 2, the operating position attachment portion 122 will abut the bottom surface of the recess 23. The pulling force of the operator, the shape of the recess 23, and the shape of the attachment portion 120, will guide the movement of the rope loop 115, such that the resting position attachment eyelet 121 stops clasping the attachment pin, and the rope loop is moved into a position where the operating position attachment eyelet 122 clasps the attachment pin 41 instead. This is possible even though, in the transition region 123, the distance between the two leg segments defining the attachment portion, 120 is smaller than the diameter of the fastening pin 41, since the transition region 123 is resilient. A snap-in movement will occur, and once the fastening pin 41 has passed the transition region 123, the transition region 123 will spring back to its original shape, such that the fastening pin 41 is trapped in the operating position attachment eyelet 122.

The rope loop 115 is in its operating position when the operating position attachment eyelet 122 of the attachment portion 120 clasps the fastening pin 41. The plane P of the receiving portion 110 is essentially vertical, and perpendicular to the pivot axis PA, when the rope loop 115 is in the operating position. A rope loop in the operating position is shown in FIG. 2*a*. Since the operating position attachment eyelet 122 clasps the fastening pin 41, no part of the rope loop 115 will hit the bottom wall of the recess 23 if the rope loop is pivoted about the pivot axis PA when it is in the operating position. Consequently, the position of the receiving portion 110 relative to the chain saw body portion 2 is flexible when the rope loop 115 is in the operating position. In the upward and downward directions, the rope loop can be turned about the pivot axis PA until the receiving portion 110 abuts the chain saw body portion 2.

In order to bring the rope loop 115 from the operating position to the resting position, the operator turns the receiving portion 110 upwardly about the pivot axis PA until a part of the receiving portion 110 abuts the body portion 2. Then the operator presses a part of the receiving portion 110 that is distal to the body portion 2 such that this part approaches the body portion 2. This will cause the rope loop 115 to rotate about its Y axis. Furthermore, the rope loop 110 will move downwardly such that the fastening pin 41 is forced into the resilient transition region 123 and further into the resting position attachment eyelet 121. Once the fastening pin 41 has passed into the resting position attachment eyelet 121, the transition region 123 will revert to its original shape, such that the fastening pin 41 is captured in the resting position attachment eyelet 121.

As previously mentioned, it is possible to adjust the tensile strength of the operating position attachment eyelet 122 by selecting the length of the overlapping portion. The amount of overlap may for example be selected such that the operating position attachment eyelet 122 keeps its shape when it is exposed to a pulling force of a few kilograms, in order to resist e.g. the weight of a hanging chain saw 1, and such that the operating position attachment eyelet 122 breaks when it is exposed to a considerably stronger pulling force, such as the force created by a falling operator who is connected to a safety rope which is attached to the rope loop 115.

According to an embodiment of the invention, the receiving device 100 comprises a hook receiving component 130 which is arranged for connecting the chain saw 1 to a harness worn by the chain saw operator. A hook, such as a snap hook, connected to the harness of the operator can be attached to the hook receiving component 130. Hereinafter, the hook receiving component 130 is referred to as a hook loop 130. When the chain saw operator needs to move from one position to another in a tree, he or she can attach the chain saw to the harness by means of a snap hook and the hook loop 130, and let the chain saw hang freely from the harness. Then, the operator has both hands available for climbing in the tree.

Figure 5:
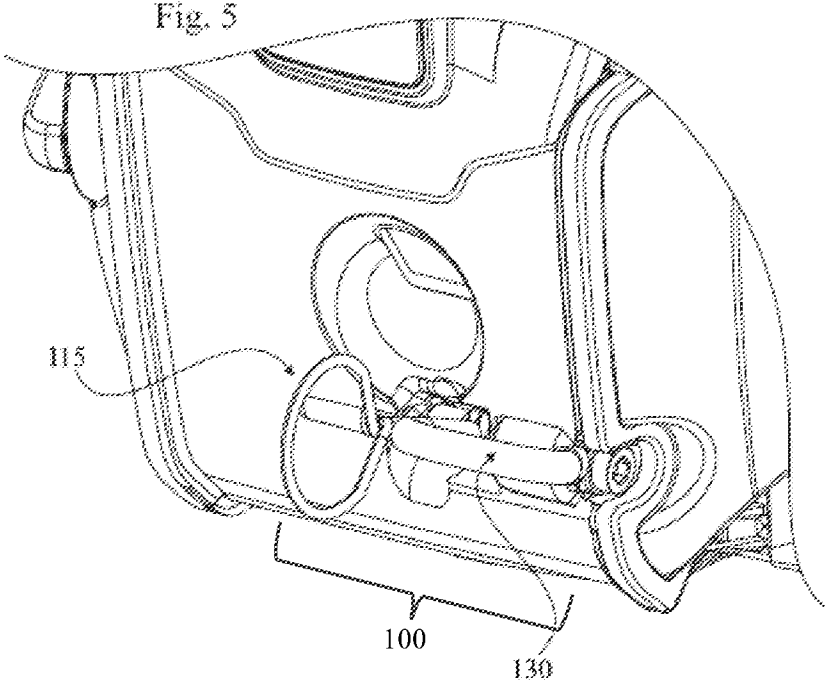
FIG. 5 is a detail view of a rearward end of the body portion of the top-handle chain saw of FIG. 1, showing a second embodiment of the receiving device.

A receiving device 100 having a rope loop 115 as well as a hook loop 130 is shown in FIG. 5. As shown in the figure, the hook loop 130 is arranged to be attached to the chain saw body portion 2 by means of the same pivot assembly 4 as the rope loop 115.

Figure 4:
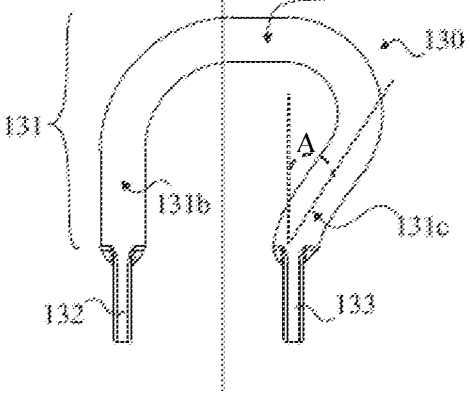
FIG. 4 is a top plan view of a hook receiving component according to an embodiment of the invention.

FIG. 4 is a top plan view of a hook loop 130 according to an embodiment of the invention.

A hook loop 130 as the one shown in FIG. 4 is formed by bending a piece of rod shaped material into the requested shape. According to an embodiment of the invention, the hook loop 130 is formed from an aluminium rod, having a diameter of 6 mm.

The end portions 132, 133 of the hook loop 130 are flat pressed, and in each end portion 132, 133, a through hole is made for leading through the fastening pin 41. A curved portion 131 extends between the end portions 132, 133.

As shown in FIG. 4, the curved portion 131 of the hook loop 130 may be asymmetric. A preferred embodiment of the curved portion 131 has the shape of a distorted U, with a base 131*a*, and two leg portions 131*b*, 131*c*.

A longitudinal direction L of the hook loop extends from the end portions 132, 133 towards the base 131*a* of the mid portion 131.

The first leg portion 131*b* is substantially parallel to the longitudinal direction L of the hook loop 130, whereas the inclined leg portion 131*c* extends at an angle A to the longitudinal direction L of the hook loop 130.

The hook loop 130 is arranged to be connected to the chain saw body portion in such a way that an extension plane of the mid portion 131 is essentially parallel to a horizontal plane of the chain saw 1. When the chain saw is attached to the operator harness by means of a snap hook, an extension direction like that makes the chain saw 1 hang in a suitable direction. It may also be even more advantageous to let the longitudinal direction of the hook loop extend slightly upwards relative to the horizontal plane of the chain saw, as shown in FIGS. 1 and 5. This will make the hanging direction of the chain saw even more favourable for the operator.

The hook loop 130 is preferably designed such that it effects the mobility of the rope loop 115 as little as possible. In the embodiment shown in FIG. 5, the movement of the rope loop 115 is not at all effected by the hook loop 130, since the two loops are positioned alongside each other. The rope loop 115 is attached to the fastening pin next to the first end portion 132 of the hook loop.

According to another embodiment of the invention, the receiving device is designed such that the rope loop is attached to the fastening pin in a position in between the two end portions 132, 133 of the hook loop. In order to minimize the effect that the hook loop has on the mobility of the rope loop, a hook loop according to an embodiment like that is preferably bent such that the extension plane of the hook loop lies below the pivot axis PA when the hook loop is attached to the chain saw body portion 2.

At the widest point of the hook loop 130, the distance between the two leg portions 131*b*, 131*c* can e.g. be about 20-30 mm. In the longitudinal direction, a distance between the centre of the through holes in the end portions 132, 133, and the base 131*a* of the curved portion 131, can e.g., be about 30-35 mm. The distance between the end portions can e.g. be about 15-25 mm.

If a spring clip type of hook, having a spring loaded gate that keeps the clip closed is used for connecting the hook loop 130 to the operator's harness, a hook loop 130 with an inclined leg portion 131*c* as the one shown in FIG. 4 is especially favourable, since the inclined leg portion 131*c*, is helpful for opening the spring loaded gate of the spring clip when the operator wants to disconnect the chain saw from the harness. The operator may hold the chain saw by one hand, turn it slightly while lifting it upwards and press the inclined leg portion 131*c* of the hook loop towards the spring loaded gate so as to open the gate and release the chain saw. The operator doesn't have to use his or her free hand for opening the spring clip. Instead this hand is available for gripping a tree in which the operator may be positioned.

Since the inclined leg portion 131*c* extends at an angle A to the longitudinal direction L of the hook loop 130, the chain saw operator has to turn the chain saw only slightly while removing it from the spring clip is. If this leg portion 131*c* would have been parallel to the longitudinal direction L of the hook loop 130 the operator would have had to turn the chain saw more. Consequently, removal of the chain saw from a spring clip is made more comfortable for the chain saw operator thanks to the inclined extension direction of the inclined leg portion 131*c*.

According to the embodiment shown in FIG. 4, the size of angle A is about 30 degrees, but other angle sizes are also possible.

The hook loop may be supplied as an optional accessory, such that the operator can attach it to the pivot assembly if he or she wants to use it, and detach it when he or she is going to use the chain saw in a situation where a hook loop is not needed.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A portable handheld power tool having a receiving device arranged on a body portion of the power tool, which receiving device is arranged for connecting/disconnecting to the portable handheld power tool either a flexible elongated member or a fastening device secured to the elongated member or to an operator of the portable handheld power tool, and which receiving device includes:

a receiving portion, substantially extending in a plane, to receive and lead the flexible elongated member therethrough, and an attachment portion, wherein the attachment portion is arranged to connect the receiving device to the body portion of the portable handheld power tool via a pivot assembly, defining a pivot axis, so as to permit the receiving portion to move between a resting position wherein the plane of the receiving portion is essentially parallel to the pivot axis, and an operating position;

and wherein in the operating position, the receiving portion is movable about the pivot axis, and the plane of the receiving portion is essentially perpendicular to the pivot axis.

2. A power tool according to claim 1, wherein, in the resting position, the receiving portion is recessed in a recess of the body portion of the portable handheld power tool.

3. A power tool according to claim 1, wherein the receiving portion and the attachment portion are formed integrally from one single piece of material.

4. A power tool according to claim 1 wherein the receiving portion and the attachment portion are made of spring wire.

5. A power tool according to claim 1, wherein the attachment portion comprises a first sub portion to connect the receiving device to the pivot assembly in the resting position, and a second sub portion to connect the receiving device to the pivot assembly in the operating position, and wherein the second sub portion extends in a first plane that is essentially perpendicular to a second plane in which the first sub portion extends.

6. A power tool according to claim 5, wherein the second sub portion of the attachment portion extends in essentially the same plane as the receiving portion.

7. A power tool according to claim 5, wherein the pivot assembly has a fastening pin, and wherein the first sub portion and the second sub portion are separated by an intermediate sub portion, defining a passage that is narrower than a diameter of the fastening pin, in order to retain the receiving device in either the operating position or the resting position, wherein the intermediate sub portion is resilient, so as to permit a snap-in movement of the receiving device relative to the pivot assembly, between the operating position and the resting position of the receiving device.

8. A power tool according to claim 1, wherein the receiving device further comprises a hook receiving component, arranged for connecting an external object to the body portion of the portable handheld power tool via the pivot assembly.

9. A power tool according to claim 8, wherein the hook receiving component is arranged to have only a limited mobility in relation to the pivot axis defined by the pivot assembly.

10. A power tool according to claim 1, which power tool is a so called top-handle chain saw, having a handle located above a body portion of the chain saw, and wherein the receiving device is arranged on the body portion.

11. A top-handle chain saw where a handle is located above a body portion of the chain saw, which top-handle chain saw has a receiving device including a hook receiving component for connecting external objects to the body portion of the chain saw, wherein the receiving device includes:

a flexible member connecting component having a receiving portion to receive and lead a flexible elongated member or a part of a fastening device secured to the flexible elongated member therethrough, and an attachment portion to connect the receiving portion to the body portion, wherein the receiving device is arranged at a rearward end of the body portion, wherein the attachment portion is connected to the body portion via a pivot assembly defining a pivot axis, and wherein the hook receiving component is arranged to be connected to the body portion of the chain saw via the same pivot assembly as the flexible member connecting component.

12. A top-handle chain saw according to claim 11, wherein the hook receiving component is arranged to be detachably connected to the body portion.

13. A top-handle chain saw according to claim 11, wherein the receiving portion of the flexible member receiving component has a main extension plane, and the hook receiving component has a main extension plane, wherein the flexible member receiving component and the hook receiving component are arranged to be connected to the pivot assembly such that the main extension plane of the hook receiving component is essentially perpendicular to the main extension plane of the flexible member receiving component.

14. A top-handle chain saw according to claim 11, wherein the flexible member connecting component is arranged to be pivotable about the pivot axis, so as to permit the receiving portion to move between a resting position, and an operating position.

15. A top-handle chain saw according to claim 14, wherein, in the operating position, the receiving portion is movable about the pivot axis, and a main extension plane of the receiving portion is essentially perpendicular to the pivot axis, and wherein, in the resting position, the main extension plane of the receiving portion is essentially parallel to the pivot axis.

16. A top-handle chain saw according to claim 11, wherein the body portion is arranged to hold the receiving device and the pivot assembly, such that the pivot axis of the pivot assembly is essentially parallel to a horizontal plane of the body portion of the top-handle chain saw.

17. A top-handle chain saw where a handle is located above a body portion of the chain saw, which top-handle chain saw has a receiving device including a hook receiving component for connecting external objects to the body portion of the chain saw, wherein the receiving device includes:

a flexible member connecting component having a receiving portion to receive and lead a flexible elongated member or a part of a fastening device secured to the flexible elongated member therethrough, and an attachment portion to connect the receiving portion to the body portion, wherein the receiving device is arranged at a rearward end of the body portion, wherein the attachment portion is connected to the body portion via a pivot assembly defining a pivot axis, and wherein the hook receiving component has a curved portion to receive an external object, which curved portion has the shape of a distorted U, comprising a first leg section, a second leg section, and a base section interconnecting the two leg sections, wherein the second leg section extends at an angle with the first leg section.

* * * * *